US007076197B2

(12) United States Patent
Tanaka

(10) Patent No.: US 7,076,197 B2
(45) Date of Patent: Jul. 11, 2006

(54) FIXING DEVICE AND IMAGE FORMING APPARATUS USING THE SAME

(75) Inventor: Hajime Tanaka, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 150 days.

(21) Appl. No.: 10/891,354

(22) Filed: Jul. 13, 2004

(65) Prior Publication Data

US 2005/0074263 A1 Apr. 7, 2005

(30) Foreign Application Priority Data

Oct. 6, 2003 (JP) ..... 2003-346665

(51) Int. Cl.
*G03G 15/20* (2006.01)

(52) U.S. Cl. ..... 399/328; 399/333

(58) Field of Classification Search ..... 399/107, 399/122, 320, 321, 328, 330, 331, 333; 219/216
See application file for complete search history.

(56) References Cited

U.S. PATENT DOCUMENTS

| | | | | |
|---|---|---|---|---|
| 5,493,380 | A * | 2/1996 | Saitou et al. | 399/328 |
| 6,304,740 | B1 * | 10/2001 | Ciaschi et al. | 399/328 |
| 6,611,670 | B1 * | 8/2003 | Chen et al. | 399/328 |
| 2003/0063916 | A1 * | 4/2003 | Katayanagi et al. | 399/44 |

* cited by examiner

*Primary Examiner*—Hoan Tran
(74) *Attorney, Agent, or Firm*—Squire, Sanders & Dempsey L.L.P.

(57) ABSTRACT

A fixing device for fixing a recording sheet, including:

a heating roller, a pressure roller, and an exterior heating roller;

wherein the hardness of the elastic layer of the heating roller is less than that of the elastic layer of the pressure roller, and wherein the heat conductivity of the elastic layer of the heating roller is equal to or less than 0.2 W/m K, and the heat conductivity of the elastic layer of the pressure roller is equal to or greater than 0.4 W/m K.

3 Claims, 4 Drawing Sheets

FIXING DEVICE AND IMAGE FORMING APPARATUS USING THE SAME

BACKGROUND OF THE INVENTION

The present invention relates to a fixing device in which a recording material carrying a toner image is heated and is pressed between a heating roller and a pressure roller so that fixing is achieved, and an image forming apparatus including the same, and in particular, a fixing device wherein an external heating roller is provided which is in contact with the surface of the heating roller, and an image forming apparatus including the same.

In an image recording apparatus employing an electrophotographic method, such as a copying machine, a facsimile device, and a laser printer, widely used is a fixing device wherein toner images are formed on a photoconductor, and after the toner images are transferred onto a recording sheet, the sheet is conveyed between a heating roller, which houses a heat source in a cored cylinder and generates heat through an elastic layer which is formed on the outer circumferential surface of the cored cylinder, and a pressure roller which comes in contact with the heating roller, and thereby the toner images are permanently fixed onto the recording sheet by heat and pressure.

Recently, due to the increased speed of image recording apparatus, feeding rate of the recording sheets also has become higher, and further, due to colorization of image and improvement of image quality, a rubber layer, having lower heat conductivity and being normally used for the elastic layer of the heating roller, is required to become thicker, and therefore, it is necessary that the heat source mounted in the cored cylinder must supply an increased amount of heat.

However, when heat from the heat source in the cored cylinder is increased excessively, the elastic rubber layer is damaged by the heat, and the durability of the elastic rubber layer is deteriorated, whereby a problem results in that the elastic layer is unglued from the cored cylinder.

In order to overcome these problems, proposed are a fixing device and an image recording apparatus using the fixing device, providing an auxiliary heating roller which comes into pressure-contact with the heating roller, and heats the surface of the heating roller from the outside (Patent Documents 1 and 2), or a fixing device and an image recording apparatus, providing an auxiliary heating roller which heats the surface of the pressure roller from the outside (Patent Document 3).

Patent Document 1: Japanese Tokkai 2001-22214

Patent Document 2: Japanese Tokkai 2003-280435

Patent Document 3: Japanese Tokkai 2002-49265

However, in both of these technologies disclosed in Patent Documents 1 and 2, since a pressure roller is a hard roller, though high image quality such as halftone is required, reproductivity of the image is not sufficient. Further, in technology disclosed in Patent Document 3, a heat source is stored in a first fixing roller (heating roller), it takes long times to heat up the surface of the elastic layer to the level of fixing temperature, and if the heating capacity of the heat source is increased too large, the elastic layer made of a rubber is affected by the heat deterioration, which is a problem.

SUMMARY OF THE INVENTION

An objective of the invention is to solve the above problems and to provide a fixing device having such a structure wherein an external heating roller comes into contact with the circumferential surface of the heating roller not having an interior heat source, and further, another objective is, by employing an image forming apparatus using said fixing device, though being a simple structure, to provide a fixing device for producing stable quality without problems such as the deterioration of the durability due to the heat deterioration of the elastic rubber layer of the heating roller, resulting in delamination between the elastic layer and the cored cylinder, and still further to provide an image recording apparatus providing with the fixing device mentioned above.

The objectives of the present invention are attained by the structures described below.

Structure 1

A fixing device for fixing a recording sheet carrying a toner image, including:

(1) a heating roller which rotates and comes into contact with a surface carrying the toner image, of the recording sheet, including, a cored cylinder, an elastic layer which is formed of a rubber on an exterior surface of the cored cylinder, and a toner releasing layer formed of a fluorine resin on a surface of the elastic layer;

(2) a pressure roller which comes into contact with the heating roller to nip the recording sheet carrying the toner image, including, a heat source for heating the pressure roller, a cored cylinder for including the heat source, an elastic layer formed of a rubber on an exterior surface of the cored cylinder of the pressure roller, and a toner releasing layer formed of a fluorine resin on a surface of the elastic layer of the pressure roller; and (3) an exterior heating roller which comes into contact with the heating roller to heat the heating roller, including, a heat source for heating the exterior heating roller, a cored cylinder for housing the heat source of the exterior heating roller, and a toner releasing layer formed of a fluorine resin on an exterior surface of the cored cylinder of the exterior heating roller;

wherein Asker-C hardness of the elastic layer of the heating roller is less than Asker-C hardness of the elastic layer of the pressure roller, and wherein the heat conductivity of the elastic layer of the heating roller is equal to or less than 0.2 W/m K, and the heat conductivity of the elastic layer of the pressure roller is equal to or greater than 0.4 W/m K.

Asker-C Hardness:

The roller having the elastic layer was measured by Asker-C type hardness meter which was manufactured by Kobunshi Keiki Co., Ltd. Asker-C type hardness meter is suitable for measuring the hardness of the roller having the elastic layer of the fixing device.

Structure 2

The fixing device described in structure 1, wherein the pressure roller is released from the heating roller when the recording material sheet carrying the toner image is not conveyed.

Structure 3

A color image forming apparatus which performs a double sided printing, including the fixing device described in structure 1 or 2.

The effects of the invention will be described below.

Based on the invention described in structure 1, since there is no need to mount the heat source in the heating roller, the cored cylinder is not heated excessively, and thereby, prevented is deterioration of roller life due to the heat deterioration as well as the unglue which may result between the elastic layer and the cored cylinder. Further, since heating is not performed through the cored cylinder of the heating roller and the elastic layer, a fixing device featuring high heat conductivity and lower electric power consumption can be realized.

Based on the invention of structure 2, since the pressure roller is released from the heating roller when the recording material is not fed between them, prevented is permanent deformation of the elastic layer of the heating roller and the elastic layer of the pressure roller.

Based on the invention of structure 3, it is possible to provide the color image forming apparatus which can produce the color image of high quality on the front and back pages of the recording sheet, without any problem caused by deterioration of the elastic layer of the fixing device.

DETAILED DESCRIPTION OF THE PREFERRED EMBODIMENT

The following describes the embodiments of the present invention. The assertive statements regarding the embodiments of the present invention indicate the best mode. They do not restrict the meaning of the terminologies of the present invention or the technological scope.

Figure 1:
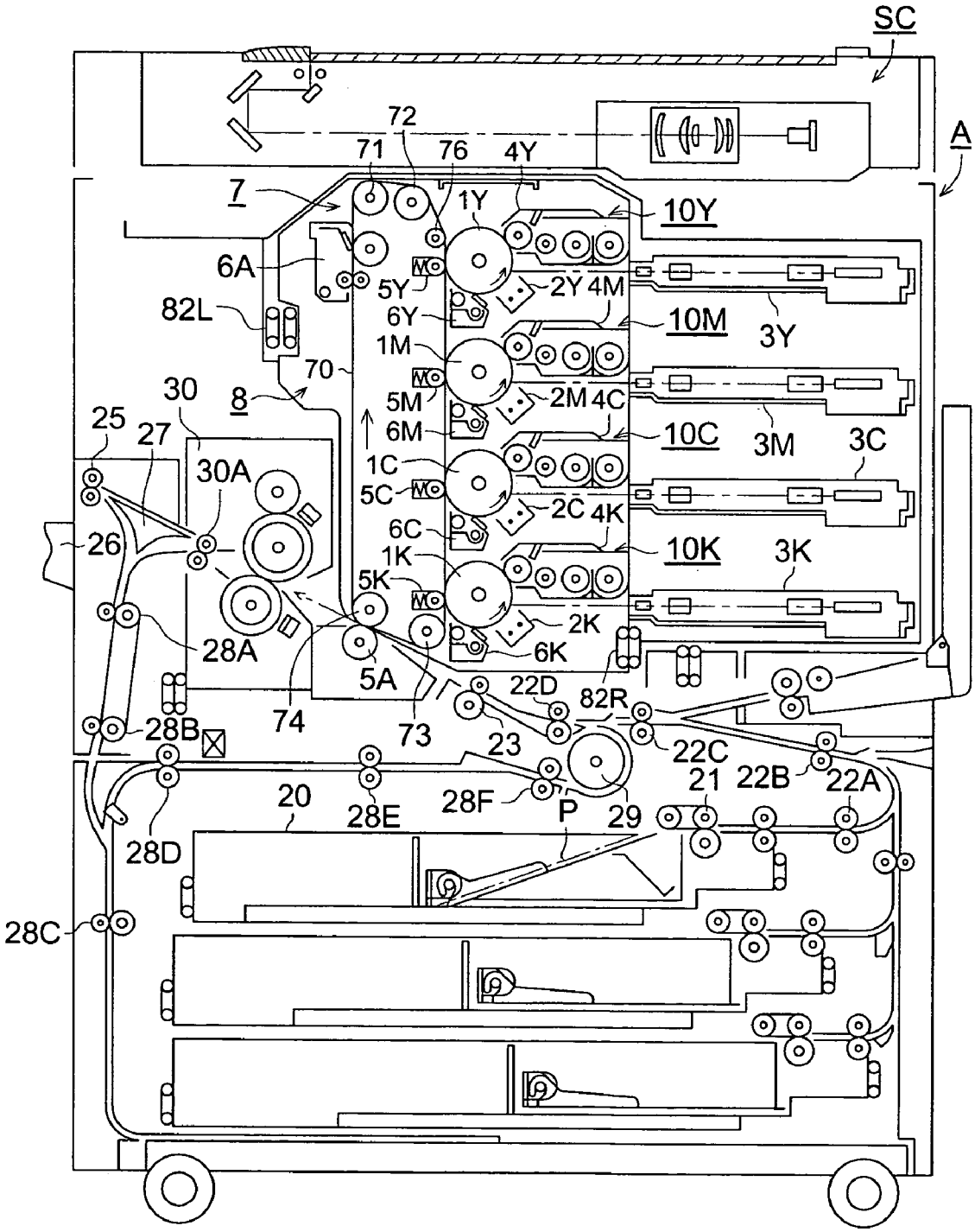
FIG. 1 is a cross sectional schematic view of an embodiment of a color duplex image forming apparatus employing the fixing device of the present invention.

FIG. 1 is a cross sectional view of the color duplex image forming apparatus showing one embodiment of an image forming apparatus according to the present invention.

This color duplex image forming apparatus is called a tandem type color image forming apparatus, and has multiple sets of image forming units 10Y, 10M, 10C and 10K, an endless transfer belt unit 7, paper feed means and heat fixing device 24. A document readout apparatus SC is installed on the top of the main unit A of the image forming apparatus.

The image forming unit 10Y forming an yellow image has charging means, arranged around a drum-shaped photoconductor 1Y as a first image carrier, exposure means 4Y, developing means 4Y, a primary transfer roll 5Y as primary trans means, and cleaning means 6Y. The image forming unit 10M for forming a magenta image has a drum-shaped photoconductor 1M as a first image carrier, charging means 2M, exposure means 3M, developing means 4M, a primary transfer roll 5M as primary transfer means, and cleaning means 6M. The image forming apparatus 10C for forming a cyan image has a drum-shaped photoconductor 1C as a first image carrier, charging means 2C, exposure means 3C, developing means 4C, primary transfer roll 5C as primary transfer means, and cleaning means 6C. The image forming apparatus 10K for forming a black image has a drum-shaped photoconductor 1K as a first image carrier, charging means 2K, exposure means 3K, developing means 4K, a primary transfer roll 5K as primary transfer means and cleaning means 6K.

The endless transfer belt unit 70 has an endless transfer belt 70 as a second semiconducting endless belt-shaped image carrier wound and rotatably supported by multiple rolls 71, 72, 73, 74 and 76, and supported.

Images formed by the image forming units 10Y, 10M, 10C and 10K are sequentially transferred onto the endless transfer belt 70 rotated by the primary transfer rolls 5Y, 5M, 5C and 5K, whereby a synthesized color image is formed. Sheet P as a transfer material (transfer material is hereafter called sheet P) that is a recording medium stored inside a paper feed cassette 20 is fed by paper feed means 21, and is sent to the secondary transfer means 5A via multiple intermediate rolls 22A, 22B, 22C and 22D and a resist roll 23, whereby the color image is transferred on sheet P in one operation. The sheet P where the color image has been transferred is subjected to fixing process by a heat fixing device 24, and is gripped by an ejection roll 25. Then it is placed on the ejection tray 26 outside the apparatus.

Cleaning means 6A removes residual toner from the endless transfer belt 70 having curve-separated sheet P after color image has been transferred onto secondary transfer means 5A.

In addition, when the images are printed on the both sides of sheet P, sheet P which is carrying a transferred image on one of its sides is processed in fixing device 30, and after sheet P is ejected by paired fix ejecting rollers 30A, revering lever 27 is moved counterclockwise, and sheet P is guided toward paired turnaround rollers 28A, 28B, and 28C. When the back end of sheet P, guided by turnaround rollers 28A, 28B, and 28C, passes between turnaround rollers 28A and 28B, and approaches reversing paired rollers 28C, paired turnaround rollers 28C are reversed, and sheet P is conveyed toward turnaround roller 29 via paired turnaround rollers 28E and 28F. sheet P, reversed by turnaround roller 29, passes between paired intermediate rollers 22D and paired registration rollers 23, and is conveyed toward secondary transfer means 5A, whereby an image is transferred onto the other side of sheet P.

Sheet P, carrying the transferred image, is processed in fixing device 30, and arrives at transfer changeover lever 27 via fix ejecting rollers 30A. Reversing lever 27 then rotates clockwise, before sheet P arrives. Whereby sheet P is nipped by paired ejecting rollers 25, and ejected onto tray 26, located outside the apparatus.

During the image formation process, the primary transfer roller 5K is always kept in pressure contact with photoconductor 1K. Other primary transfer rollers 5Y, 5M and 5C are kept in pressure contact with respective corresponding photoconductors 1Y, 1M and 1C only during color image formation.

Secondary transfer means 5A is in pressure contact with endless transfer belt 70 only when sheet P passes and secondary transfer is performed.

Figure 2:
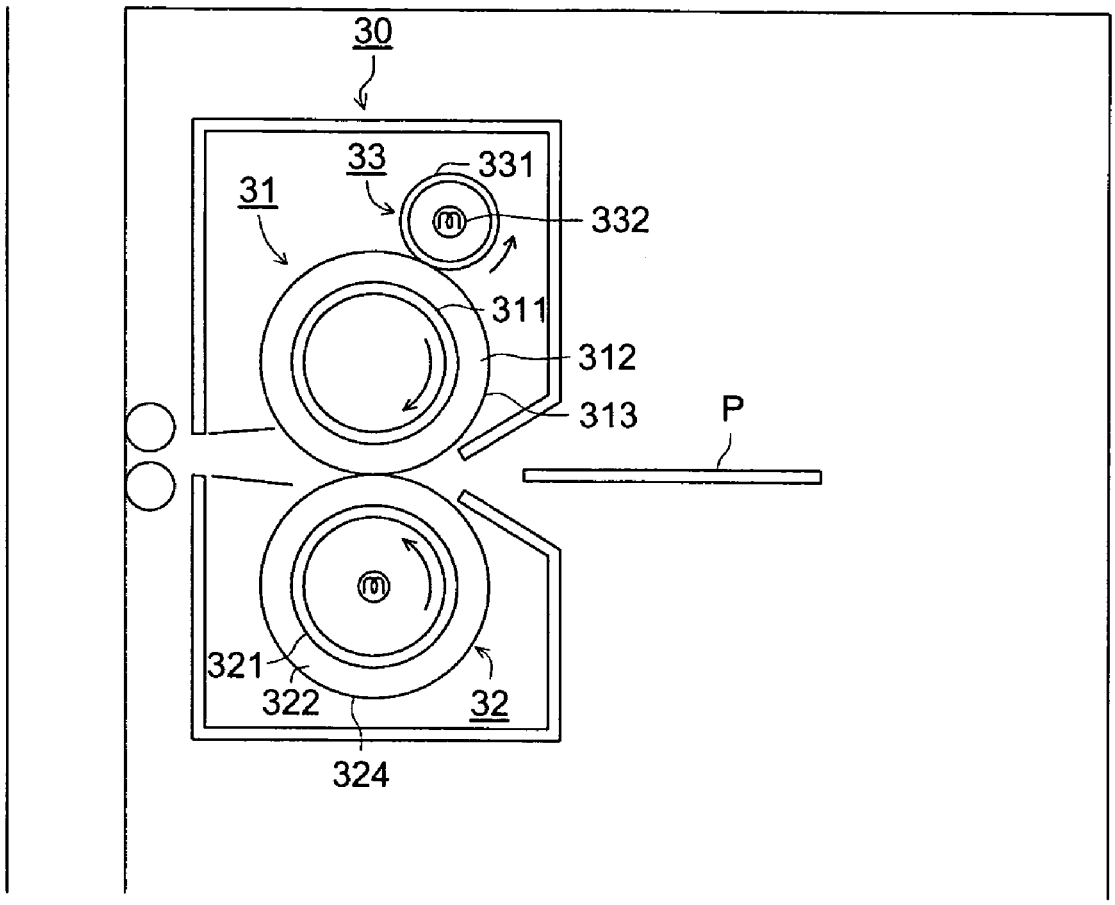
FIG. 2 is a cross sectional view showing the structure of the first embodiment of the fixing device of the present invention.

FIG. 2 is a cross sectional view showing the structure of the first embodiment of the fixing device of the present invention.

In FIG. 2, fixing device 30 includes heating roller 31 excluding the heat source, pressure roller 32 being in pressure-contact with heating roller 31, and external heating roller 33 being also in pressure contact with heating roller 31.

Heating roller 31 is composed of cored cylinder 311 formed of a metal or a hard resin, elastic layer 312 formed of a rubber on the surface of cored cylinder 311, and fluorine resin layer 313 formed on the surface of elastic layer 312. Pressure roller 32 is composed of cored cylinder 321 formed of a metal or a hard resin, elastic layer 322 formed of a rubber on the surface of cored cylinder 321, and fluorine resin layer 323 (which is a toner releasing layer) formed on the surface of elastic layer 322.

External heating roller 33 is composed of roller member (which is a cored cylinder) 331 formed of aluminum or aluminum alloy, and heat source 332 which is a halogen lamp mounted within roller member 331. The surface of roller member 331 is covered with fluorine resin layer 333 (which is a toner releasing layer).

Before recording sheet P, on which toner images have been transferred, approaches fixing device 30, the heat supplied from previously energized and heated by heat source 332 reaches fluorine resin layer 313 of heating roller 31 through roller member 331 which is rotating counter-clockwise, and heats elastic layer 312 of heating roller 31 through fluorine resin layer 313. Since pressure roller 32 is pressed to heating roller 31, the heat supplied from heat source 332 is conducted from fluorine resin layer 313 of heating roller 31 to elastic layer 322 through fluorine resin layer 323 of pressure roller 32, and much more heat is supplied to elastic layer 322 of pressure roller 32, because elastic layer 322 of pressure roller 32 is formed of a material having higher thermal conductivity than elastic layer 312 of heating roller 31. The heat conductivity of elastic layers 312 and 322 are set to adequate values by changing the amount of additives of an absorbent such as carbon black.

In FIG. 2, when the image forming apparatus is under normal operating conditions, pressure roller 32 is brought into pressure-contact with heating roller 31 by a spring member, which is not illustrated. When the image forming apparatus is under a power-off condition or a stand-by condition for a long time, pressure roller 32 is released from heating roller 31 by any of the well-known means using a motor or a cam mechanism, which is not illustrated. Permanent deformation of heating roller 31 and pressure roller 32 is thereby prevented by the above releasing process.

Figure 3:
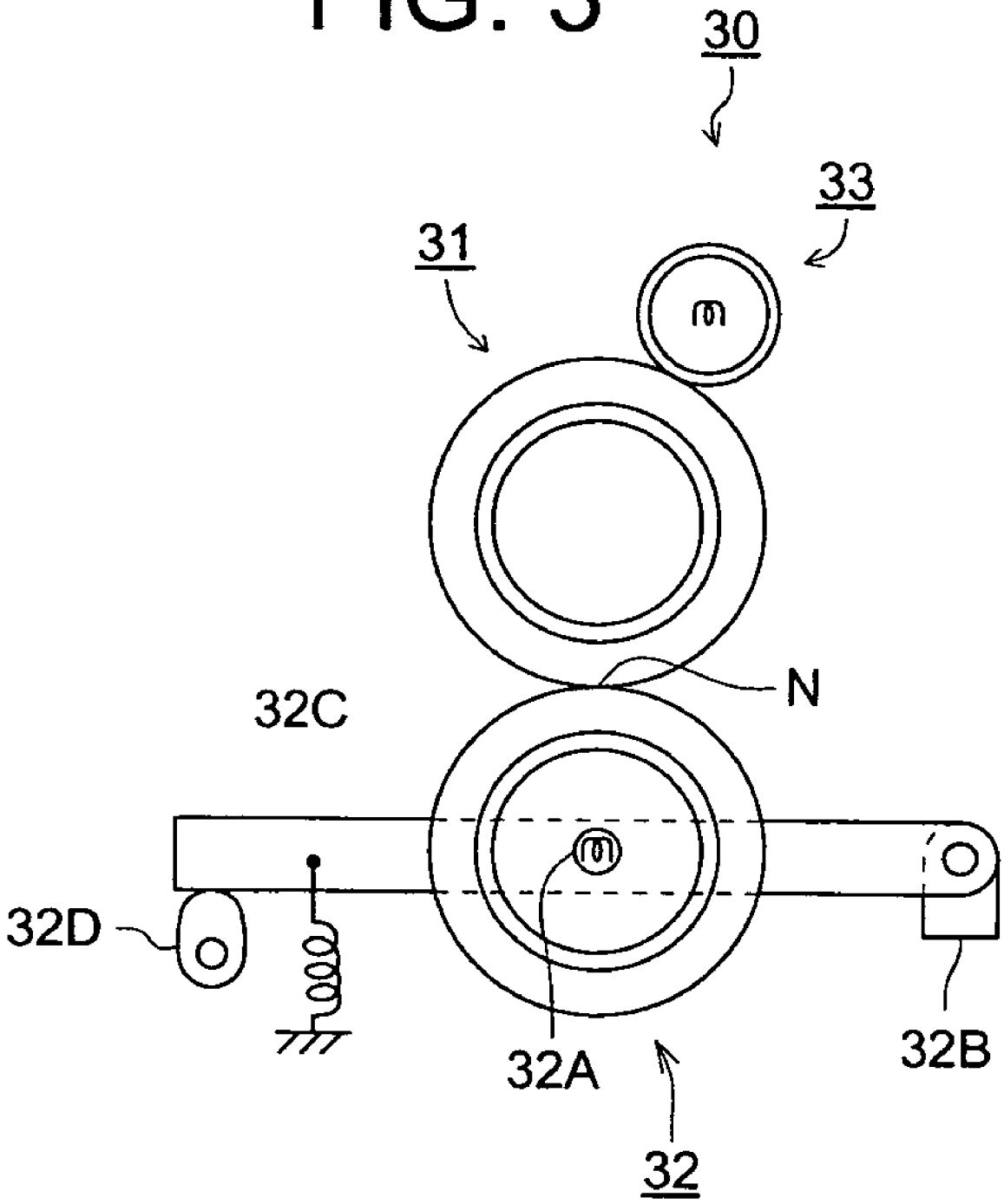
FIG. 3 is a cross sectional view showing the structure of the second embodiment of the fixing device of the present invention.

FIG. 3 is a schematic view showing the structure of the second embodiment of the fixing device of the present invention.

A position adjusting means of fixing device 30 shown in FIG. 3 is a method wherein pressure roller 32 is in pressure-contact at a the predetermined position. Both ends of rotating shaft 32A of pressure roller 32 is supported by pressing lever 32C one end of which is supported by pivoted supporting member 32B. The other end of pressing lever 32C is controlled by cam 32D to a predetermined pressing position. Cam 32D is driven by a driving source which is not illustrated. When the position of cam 32D is changed, the pressing point onto pressing lever 32C is consequently changed, and thereby, when recording sheet P is nipped, the center distance between heating roller 31 and pressure roller 32 is changed, and the nipping depth at fixing area N can be adjusted to a predetermined depth. Cam 32D is always in pressure-contact with pressing lever 32C by a spring.

Figure 4:
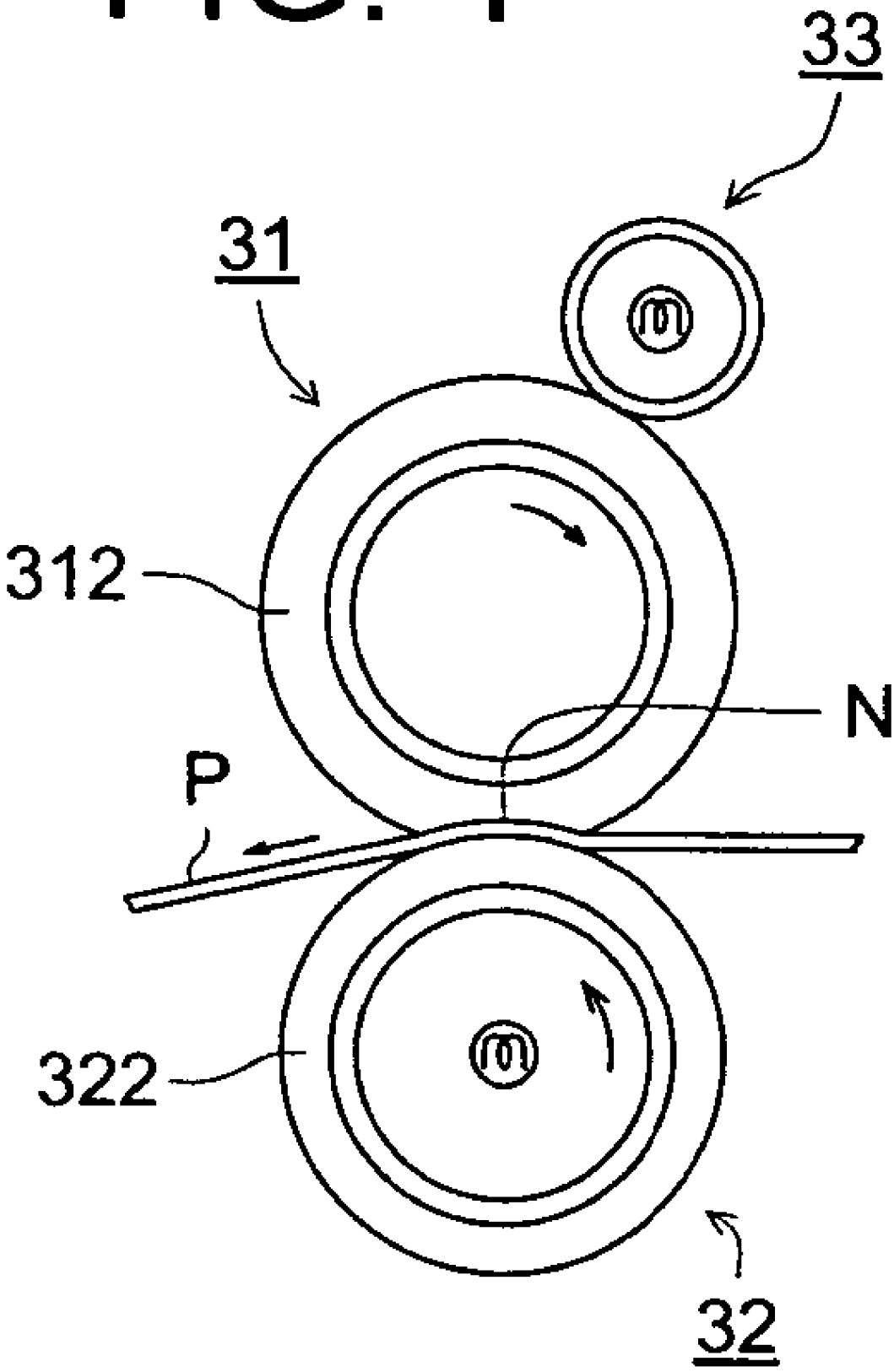
FIG. 4 is a cross sectional view showing an exaggerated condition in which recording material P has been nipped between heating roller 31 and pressure roller 32, both of which are under pressure contact.

FIG. 4 is a schematic view showing the condition in which recording sheet P has been nipped between heating roller 31 and pressure roller 32, both of which are in pressure-contact with each other. Since the hardness of elastic layer 312 of heating roller 31 is set to be less than the hardness of elastic layer 322 of pressure roller 32, elastic layer 312 of heating roller 31 is deformed as shown in FIG. 4, and thereby the top surface of recording sheet P is forced from the surface of heating roller 31 due to the hardness of sheet P, whereby sheet P easily separates from heating roller 31. The hardness of elastic layers 312 and 322 is set to adequate values by changing the amount of additives of filling agent such as an inorganic filler or a vulcanizing agent.

The inventor of the present invention performed the experiments described below, being practical examples 1 and 2, and comparative examples 1–4, using the fixing device shown in FIGS. 2 and 3, and the color duplex image forming apparatus shown in FIG. 1.

(Common Elements)

1. Heating Roller external diameter: 65 mm, surface hardness: Asker—C78°, material of cored cylinder: iron, thickness of cored cylinder wall: 3.0 mm, thermal conductivity of cored cylinder: 45 W/mK, material of elastic layer (rubber layer): silicone rubber, rubber hardness of elastic layer: JIS—25°, material of toner releasing layer: PFA, thickness of toner releasing layer: 30 μm, thermal detector of the central image area: non-contact type, thermal detector of the end image area: contact type, 2. Pressure Roller, external diameter: 55 mm, surface hardness: Asker—C83° (excluding comparative example 1), material of cored cylinder: aluminum, thickness of cored cylinder wall: 7.5 mm, thermal conductivity of cored cylinder: 220 W/mK, rubber hardness of elastic layer: JIS—45°, material of toner releasing layer: PFA, thickness of toner releasing layer: 30 μm, heat source: halogen lamp, thermal detector of the central image area: non-contact type, thermal detector of the end image area: contact type, 3. External Heat Roller external diameter: 50 mm, material of cored cylinder: aluminum, thickness of cored cylinder wall: 1.0 mm, elastic layer: not used, material of toner releasing layer: PFA, thickness of toner releasing layer: 30 μm, heat source: halogen lamp, contacting pressure: 15 N/cm, The experimental results are shown in Table 1.

TABLE 1

| Items | | | Comparative examples 1 | Comparative examples 2 | Comparative examples 3 | Comparative examples 4 | Actual examples 1 | Actual examples 2 |
|---|---|---|---|---|---|---|---|---|
| Heating Roller | Elastic layer | Thickness | 1.5 mm | 1.25 mm | | 1.5 mm | | |
| | | Thermal conductivity | | 0.2 W/mK | | 0.3 W/mK | 0.2 W/mK | |
| Pressure roller | Elastic layer | Hardness | | | 83° Asker-C | | | |
| | | Material | Non elastic layer | Si rubber including $TiO_2$ | Si rubber | Si Rubber including $TiO_2$ | | |
| | | Thickness | | 1.25 mm | | 1.0 mm | | |
| | | Thermal conductivity | | 0.4 W/mK | 0.2 W/mK | 0.3 W/mK | 0.4 W/mK | |
| Press Contact | Pressing force | | | 800 N | | 700 N | | |
| | Automatic release, while sheeet is not conveyed | | | Releasing mechanism is not employed. | | | | Exists |
| Result | Image quality | Uneven luster | Highly visible | | No problem | | | |
| | Durability test | After 100,000 prints | No Problem | Bad Separation of sheet. Wound sheet on heat roller | Broken rubber of heating roll at 20,000 prints | Broken rubber of heating roll at 50,000 prints | | No problems |
| | Fixed results | | | No problems | | Under fixing | | No problems |
| | Badly printed image | Crossed uneven luster | | Barely exist, but no problems | | | | No Problems |

Based on the experimental results by the inventor of the present invention, using the above examples, the inventor obtained the following results.

In the case of comparative example 1, since the elastic layer is not formed on the pressure roller, an uneven luster is produced on the printed image.

In the case of comparative example 2, the thickness of the elastic layer of the heating roller is equal to the thickness of the elastic layer of the pressure roller, and thereby the deformed amount of the heating roller is comparatively small while the sheet is nipped, that is, poor separation of the sheet from the heating roller occurs.

In the case of comparative example 3, the heat conductivity of the elastic layer of the pressure roller is low, and in order to obtain high fixing performance, the heat amount radiated from the heat source in the pressure roller must be high, which raises the likelihood of heat deterioration of the pressure roller.

In the case of comparative example 4, the heat conductivity of the elastic layer of the heating roller is rather high, and the heat conductivity of the elastic layer of the pressure roller is rather low, which causes that the heat is easily passed through the interior of the heating roller, resulting in the deterioration of fixing performance. In order to maintain high fixing performance, the heat amount radiated from the heat source in the pressure roller must be high, which raises the likelihood of heat deterioration of the pressure roller.

What is claimed is:

1. A fixing device for fixing a recording sheet carrying a toner image, comprising:

1) a heating roller which rotates and comes into contact with a surface carrying the toner image, of the recording sheet, including, a cored cylinder, an elastic layer which is formed of a rubber on an exterior surface of the cored cylinder, and a toner releasing layer formed of a fluorine resin on a surface of the elastic layer;

2) a pressure roller which comes into contact with the heating roller to nip the recording sheet carrying the toner image, including, a heat source for heating the pressure roller, a cored cylinder for housing the heat source, an elastic layer formed of a rubber on an exterior surface of the cored cylinder of the pressure roller, and a toner releasing layer formed of a fluorine resin on a surface of the elastic layer of the pressure roller; and 3) an exterior heating roller which comes into contact with the heating roller to heat the heating roller, including at least one of, a heat source for heating the exterior heating roller, a cored cylinder for housing the heat source of the exterior heating roller, and a toner releasing layer formed of a fluorine resin on an exterior surface of the cored cylinder of the exterior heating roller;

wherein Asker-C hardness of the heating roller is less than Asker-C hardness of the pressure roller, and wherein the heat conductivity of the elastic layer of the heating roller is equal to or less than 0.2 W/m K, and the heat conductivity of the elastic layer of the pressure roller is equal to or greater than 0.4 W/m K.

2. The fixing device described in claim 1, wherein the pressure roller is released from the heating roller when the recording sheet carrying the toner image is not conveyed.

3. A color image forming apparatus which performs a double sided printing, comprising the fixing device in claim 1.

* * * * *